United States Patent [19]

Roser et al.

[11] Patent Number: 5,018,702

[45] Date of Patent: May 28, 1991

[54] ADJUSTABLE INCLINOMETER MOUNTING ASSEMBLY

[75] Inventors: Daniel J. Roser, Benton Harbor; Teruyoshi Hirose, St. Joseph, both of Mich.

[73] Assignee: Sumitec Inc., Benton Harbor, Mich.

[21] Appl. No.: 492,302

[22] Filed: Mar. 7, 1990

Related U.S. Application Data

[63] Continuation of Ser. No. 316,976, Feb. 28, 1989, abandoned.

[51] Int. Cl.[5] ..... G10C 25/00

[52] U.S. Cl. ..... 248/904; 248/674; 248/180; 248/188.4; 164/150

[58] Field of Search ..... 164/150; 248/178, 180, 248/188.4, 674, 678, 371, 904

[56] References Cited

U.S. PATENT DOCUMENTS

| | | | |
|---|---|---|---|
| 1,018,150 | 2/1912 | Adams | 248/180 X |
| 3,568,971 | 3/1971 | Jarmy | 248/108.4 X |
| 4,302,962 | 12/1981 | Williams | 248/188.4 X |
| 4,433,824 | 2/1984 | Koosha | 248/188.4 X |
| 4,532,645 | 7/1985 | Morris | 248/674 X |

*Primary Examiner*—Alvin C. Chin-Shue

*Attorney, Agent, or Firm*—Jeffers, Hoffman & Niewyk

[57] ABSTRACT

A mounting assembly for an inclinometer which includes a base and an inclined plate whose angle of inclination with respect to the base is adjustable. The plate supports an inclinometer which is rigidly secured thereto. A cover is provided for the entire assembly and the cover has an access door for providing access to the adjusting means to adjust the angle of inclination of the inclinometer mounting plate with respect to the base.

18 Claims, 1 Drawing Sheet

ADJUSTABLE INCLINOMETER MOUNTING ASSEMBLY

This is a continuation of application Ser. No. 316,976, filed Feb. 28, 1989 now abandoned.

BACKGROUND OF THE INVENTION

This invention relates to inclinometers for continuous casting machines and in particular to a mounting assembly for an inclinometer for continuous casting molding machines.

Continuous casting machines are well known in the prior art and include a mold made up of two essentially parallel wide walls (broad face plates) and two essentially parallel narrow walls (narrow face plates) to define a casting passage of rectangular cross section. One of the narrow face plates is adjustable whereby the cross section of the mold, which determines the size of the slab to be cast in the mold, may be varied. The size of the continuous slabs formed by the continuous casting method is substantial as the slabs may be up to 12 inches thick and 100 inches wide. The mold is surrounded by a water jacket which cools the mold.

For a further description of continuous casting molds, reference may be had to U.S. patent application Ser. No. 239,530 entitled, THERMOCOUPLE FOR A CONTINUOUS CASTING MACHINE which was filed on Sept. 1, 1988 and which is assigned to the assignee of record of the present application, which description is incorporated herein by reference.

One of the narrow face plates must be held at a predetermined taper, whereby the rectangular cross section of the bottom of the mold is smaller than the rectangular cross section of the top of the mold. The reason for tapering one of the narrow face plates is to adjust the mold for shrinkage of the metal. As the molten metal cools in the mold and forms a skin around the outside of the molten metal, the metal will shrink. Thus the bottom aperture of the mold from which the slab exits should have a smaller dimension than the upper aperture of the mold into which the molten metal is poured.

The taper of the narrow face plates is determined by the shrinkage of the steel. The taper of the wall is then adjusted by means of two screws, a first one of which is secured to the upper end of the narrow face plate and the second one of which is secured to the lower end of the narrow face plate. It is extremely important that the taper of the narrow face plates be rigidly maintained during a casting run of the mold which may be as long as a week or more. If the taper is not rigidly held but changes during the molding process, it is possible that a break-out would occur, namely that the skin around the molten slab would not form properly and that cracks would occur therein whereby molten metal would spill out of the mold so that the entire molding apparatus would have to be shut down and all of the solidified metal would have to be removed therefrom and from the surrounding equipment. Thus it is extremely important that the taper of the narrow face plate be monitored, so that, if any variation therein occurs, the mold may be shut down before a break-out occurs.

For this purpose, an inclinometer is used to monitor the taper of one of the narrow face plates. The inclinometer is a device which is normally adjusted to be in a level position and which is sensitive to very slight movements away from its level position and generates an electrical signal if that situation should occur. The electrical signal is routed to signal processing equipment and to an operator who can thereby monitor, from a remote location, that the narrow face plates taper has not varied from a pre-established limit.

The inclinometer is normally mounted on top of the water jacket of one of the narrow face plate whose taper is adjustable. Once the taper has been set, the conventional method of mounting the inclinometer was to shim the inclinometer until it read zero and then to tighten the inclinometer down in that position. The space constraints for mounting the inclinometer are such that it is conventionally mounted below the pipes which supply water to the narrow face plate water jacket. Thus, if a different taper were indicated the water supply pipes had to be disconnected, the inclinometer had to be loosened, a different shim had to be placed below the inclinometer after which, a taper gage was applied to the inclinometer to insure that it was level. The inclinometer was then tightened in position, the water pipes were reconnected and the reading of the inclinometer was checked to ensure that it was proper and that the inclinometer was in a perfectly level position. If the reading was incorrect, the entire process had to be repeated until the inclinometer was properly positioned. This entire process was very time consuming and therefore very expensive due to the inability to operate the continuous casting mold during adjustment of the inclinometer. If during the continuous molding operation, the taper was not properly held, then the mold had to be shut down and the entire adjustment process of adjusting both the narrow face plate taper and the inclinometer had to be repeated.

It is therefore desired to provide an inclinometer mounting assembly which makes adjustment of the inclinometer extremely simple so that very little time is necessary to adjust the inclinometer.

SUMMARY OF THE INVENTION

The present invention provides a mounting assembly for an inclinometer for continuous casting molds wherein the mounting assembly is easy to adjust. The mounting assembly according to the present invention, in one form thereof, includes an inclined plate which is secured to a mounting base. One end of the inclined plate is fixedly secured to the base and spaced therefrom. The other end of the plate can be moved away from or toward the base to provide an adjustable inclined surface on which to mount the inclinometer. The device is very simple to adjust because the adjustments are made by means of threaded fasteners which raise or lower the inclined plate. A cover protects the inclinometer and the inclined plate from contamination. Adjustments to the mounting apparatus are made by opening a lid in the cover and by adjusting the threaded fasteners to adjust the inclination of the plate. The entire adjustment process may be accomplished without disconnecting the water supply pipes from the water jacket of the narrow face mold plate.

The present invention, in one form thereof, comprises a mounting apparatus for adjustably mounting an inclinometer on a continuous casting mold. The apparatus includes a base and a supporting plate for supporting an inclinometer. The plate is fixedly secured at a first end to the base. An adjustable securing device secures the second end of the supporting plate to the base whereby the second end may be raised or lowered with respect to the base and whereby the angle of inclination of the supporting plate with respect to the base may be adjusted.

The present invention, in one form thereof, comprises an apparatus for adjustably mounting an inclinometer on a continuous casting mold. The apparatus comprises a base for mounting the apparatus on the casting mold and a plate for supporting an inclinometer. The plate has a first end thereof spaced at a fixed distance from the base by a spacer. The first end of the plate is secured to the base. The plate defines a platform for supporting an inclinometer. The apparatus also includes an inclining means for adjustably raising or lowering the second end of the plate to incline the plate with respect to the base.

The present invention, in one form thereof, comprises an inclinometer assembly for monitoring the taper on one of the faces of a continuous casting mold. The assembly includes the base and a plate for supporting an inclinometer. The plate is secured to the base in an adjustable inclined position whereby the inclinometer may be inclined with respect to the base at any angle within a predetermined range. An adjusting device is secured to the plate for adjusting the angle of inclination. A cover is provided for covering the inclinometer and the adjusting device.

One of the advantages of the structure according to the present invention are that adjustments to the inclinometer mounting can be made without laborious disconnection of the water supply pipes from the water jacket and without using various shims to shim the inclinometer. Therefore the base of the inclinometer can remain securely fastened to the water jacket assembly of the narrow face plate and by simply adjusting various threaded fasteners, the adjustment may be made and checked in a matter of minutes. The assembly is very simple and rugged and therefore is relatively inexpensive to provide. The use of the invention eliminates laborious cut and try adjustment of the inclinometer mounting which were necessary with prior art structures.

BRIEF DESCRIPTION OF THE DRAWINGS

The above mentioned and other features and objects of this invention and the manner of attaining them will become more apparent and the invention itself will be better understood by reference to the following description of an embodiment of the invention, taken in conjunction with the accompanying drawings, wherein.

Corresponding reference characters indicate corresponding parts throughout the several views of the drawings.

The exemplifications set out herein illustrate a preferred embodiment of the invention, in one form thereof, and such exemplifications are not to be construed as limiting the scope of the disclosure or the scope of the invention in any manner.

DETAILED DESCRIPTION OF THE PREFERRED EMBODIMENT

Figure 1:
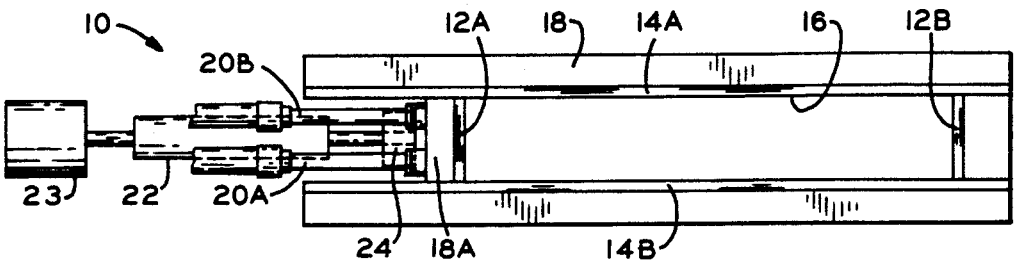
FIG. 1 is a top plan schematic view of a mold assembly including an inclinometer mounted thereon.

Referring to FIG. 1 there is seen a schematic representation of a continuous casting mold assembly including two narrow face mold plates 12*a* and 12*b* and two broad face mold plates 14*a* and 14*b*. The narrow and wide face mold plates form a mold cavity 16 into which molten metal is cast. A water jacket 18 surrounds the mold assembly including a water jacket 18*a* for the narrow face mold plate 12*a*. Connections are made for supplying water continuously to water jacket 18*a* as shown by water pipes 20*a* and 20*b*. Thus the narrow face mold plate 12*a* is cooled continuously by the supply of cooling water thereto. An inclinometer assembly 24 is mounted on top of the top ears of water jacket 18*a* but below pipes 20*a* and 20*b*. Narrow face plate 12*a* is movable from right to left to either enlarge or make smaller mold cavity 16, as desired. Narrow face plate assembly 12*a* is moved by a pair of ball screws one of which is diagramatically shown at 22 driven by motor 23 and which are respectively attached to the top and bottom of the narrow face plate assembly. In order to account for shrinkage of the molten metal as it cools and solidifies in the mold, the bottom of narrow face plate 12*a* is closer to narrow face plate 12*b* than is the top of mold narrow face plate 12*a*. Thus narrow face plate 12*a* is said to have a "taper", that is to say, an orientation away from the vertical. This causes the cross sectional dimension of the cavity 16 to be smaller at the bottom of the mold than at the top of the mold to account for shrinkage of the molten metal as it cools. This taper is set automatically by automated equipment by adjustment of the above mentioned ball screws.

Once the taper has been set, it is absolutely essential that the taper is retained throughout the casting process which may be as long as a week or more. However, due to the elevated temperatures at which the casting process takes place, the taper cannot be inspected manually but must be inspected by remote instrumentation. Inclinometer 24 is provided to monitor the taper of narrow face plate assembly 12*a* and to provide an indication when the taper is not being held.

The inclinometer assembly and mounting apparatus therefor is shown in FIGS. 2–5.

Figure 2:
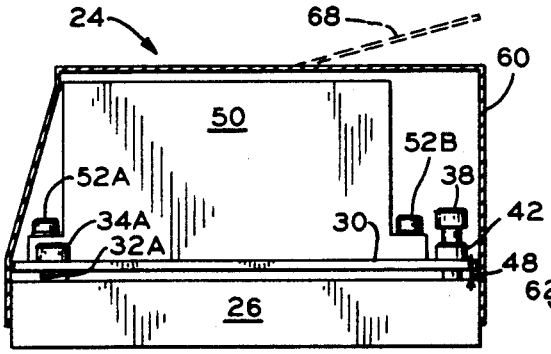
FIG. 2 is a front elevational view of a inclinometer and mounting assembly according to the present invention.
Figure 3:
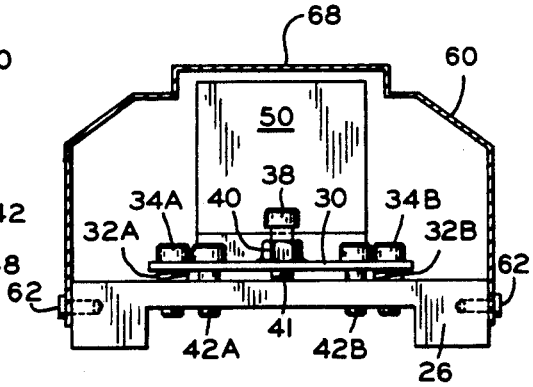
FIG. 3 is an elevational side view of the assembly of FIG. 2 taken from the right hand side thereof.
Figure 4:
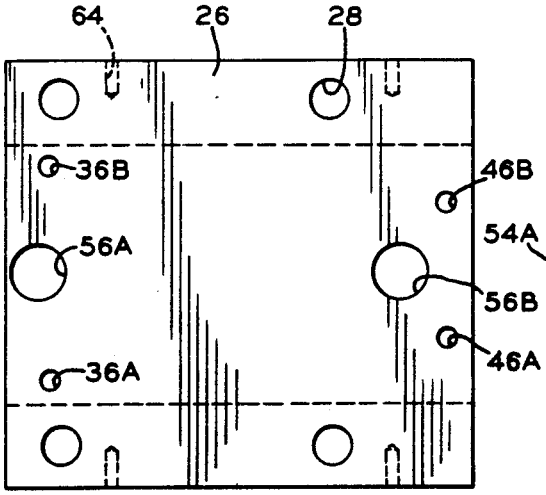
FIG. 4 is a top plan view of the base for the mounting assembly of FIG. 2.
Figure 5:
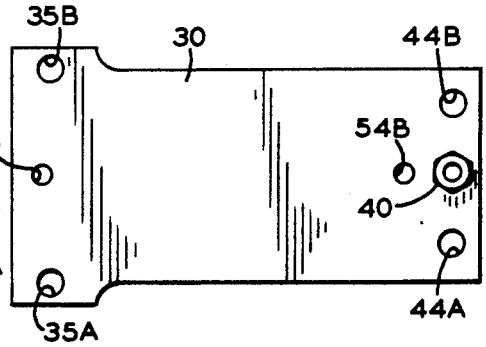
FIG. 5 is a top plan view of the mounting plate for the mounting assembly of FIG. 2.

The inclinometer assembly 24 includes a base 26 which is used for mounting the entire assembly onto the narrow face plate assembly. Threaded fasteners are disposed in apertures 28 to mount the entire assembly. A plate 30 is provided for mounting an inclinometer onto the base. Plate 30 is spaced upwardly from base 26 by means of spacers 32*a* and 32*b* as best seen in FIGS. 2 and 3. Fasteners 34*a* and 34*b* are respectively disposed in apertures 35*a* and 35*b* and are then respectively threaded into threaded apertures 36*a* and 36*b* of base 26. Thus, in effect, the plate 30 is secured as a cantilevered platform to base 26 by means of fasteners 34 and spacers 32. However, contrary to a conventional cantilever, the distal end of plate 30 is not free to move up or down but is secured in an adjustable position by means of a plurality of fasteners. A threaded stud 38 is threaded into a nut 40 which nut is welded onto or secured in some other fashion to plate 30. End 41 of stud 38 is therefore in contact with base 26, as best shown in FIG. 3, whereby clockwise turning of stud 38 causes plate 30 to move upwardly. However, fasteners 42*a* and 42*b* which project respectively through apertures 44*a* and 44*b* and which are threadedly received in threaded apertures 46*a* and 46*b* of base 26, prevent plate 30 from moving upwardly and instead pull downwardly on plate 30. Thus the upward pushing action of stud 38 and the downward pulling action of fasteners 42 are in equilibrium to secure the distal end of plate 30 in a fixed position. However, the fixed position of the distal end of plate 30 is adjustable by manipulation of stud 38 and fasteners 42*a* and 42*b*. The position of the distal end of plate 30 determines the angle of inclination of plate 30 and therefore, by simple manipulation of stud 38 and fasteners 42, the inclinometer mounting may be adjusted. Thus, by referring to FIG. 2, the distance 48 which is the space between the bottom surface of the distal end of plate 30 and the upper surface of base 26, determines the angle of inclination of plate 30, as viewed in FIG. 2, and this angle of inclination is adjustable by the manipulation of stud 38 and fasteners 42*a* and 42*b*.

An inclinometer 50 is mounted on plate 30 by the use of fasteners 52 which thread into threaded apertures 54*a* and 54*b* of plate 30. Clearance holes 56*a* and 56*b* are provided in base 26 for the distal end of fasteners 52*a* and 52*b*. A cover 60 covers the inclinometer as well as the mounting assembly to prevent contamination thereof. Cover 60 is secured to base 26 by means of fasteners 62 which thread into apertures 64 of base 26. The cover also includes a lid 68, shown diagrammatically in FIG. 2 in the open position. The lid is hinged at one end and may be opened to permit access to the interior of inclinometer assembly 24 for the adjustment of fasteners 38 and 42.

In operation, the device operates as follows. The entire inclinometer assembly is rigidly secured to the top of the water jacket of narrow face plate assembly 18*a*. Thereafter, the water pipes 20*a* and 20*b* are connected. The taper of the narrow face plate assembly 12*a* had already been set. Lid 68 of the inclinometer cover is now opened to permit access to the interior of assembly 24. A taper gage is used to determine if the inclinometer is mounted on adjustable plate 30 in a perfectly level position. If inclinometer 50 is not in a level position but must be tilted downwardly, fastener 38 is turned counter clockwise and fasteners 42 are turned clockwise to adjust the distal end of plate 30 downwardly. When the taper gage indicates that inclinometer 50 is level, stud 38 and fasteners 42 will be tightened. If however inclinometer 50 must be inclined at a greater angle of inclination with respect to base 26, fasteners 42 are loosened by turning them counter clockwise and stud 38 is turned clockwise to force distal end 41 of stud 38 to move plate 30 upwardly and away from base 26. After checking the taper gage to determine if the position of the inclinometer 50 is level, the stud 38 and fasteners 42 are tightened.

It should be noted that various other means may be provided for adjusting the position of the distal end of plate 30. While this invention has been described as having a preferred design, it will be understood that it is capable of further modification. This application is therefore intended to cover any variations, uses, or adaptations of the invention following the general principles thereof and including such departures from the present disclosure as come within known or customary practice in the art to which this invention pertains and fall within the limits of the amended claims.

What is claimed is:

1. A continuous casting apparatus comprising:
a mold including a face plate;
a base secured to said face plate;
an inclinometer mounted on said base;
a supporting plate fixedly secured at a first end to said base for supporting said inclinometer; and
adjustable securing means for adjustably securing a second end of said supporting plate to said base whereby said second end may be raised or lowered with respect to said base and whereby the angle of inclination of said supporting plate with respect to said base may be adjusted.

2. The apparatus according to claim 1 wherein said first end of said supporting plate is secured to said base by a threaded fastener, said supporting plate being spaced from said base at said first end by spacing means.

3. The apparatus according to claim 1 wherein said adjustable securing means comprises a raising means for moving said second end of said supporting plate away from said base and a lowering means for moving said second end of said plate toward said base.

4. The apparatus according to claim 3 wherein said raising means comprises a threaded nut secured to said plate and a threaded stud threadedly received in said nut.

5. The apparatus according to claim 3 wherein said lowering means comprises a threaded fastener which engages with a threaded aperture in said base.

6. The apparatus according to claim 1 including a cover for covering said mounting apparatus and an inclinometer mounted thereon.

7. The apparatus according to claim 6 wherein said covering includes a movable access for providing access to said adjustable securing means.

8. A continuous casting apparatus comprising:
a mold including a face plate;
an inclinometer mounted on said face plate;
base means for mounting said inclinometer on said mold face plate;
plate means having a first end thereof spaced at a fixed distance from said base by spacer means, said plate means having said first end thereof secured to said base, said plate means defining a platform for supporting said inclinometer; and
inclining means for adjustably raising or lowering a second end of said plate means, to incline said plate means with respect to said base means.

9. The apparatus according to claim 8 wherein the first end of said plate means is secured to said base means by a threaded fastener.

10. The apparatus according to claim 8 wherein said inclining means comprises a raising means for raising a second end of said plate means and a lowering means for lowering a second end of said plate means.

11. The apparatus according to claim 10 wherein said raising means comprises a threaded nut secured to said plate and a threaded stud threadedly received in said nut.

12. The apparatus according to claim 10 wherein said lowering means comprises a threaded fastener secured in threaded apertures in said base means.

13. The apparatus according to claim 10 including a cover for covering said mounting apparatus and an inclinometer mounted thereon.

14. The apparatus according to claim 13 wherein said cover includes a movable access means for providing access to said inclining means.

15. A continuous casting machine comprising:
a mold including a face plate;
an inclinometer mounted on said face plate;

a base secured to said face plate;

a plate for supporting said inclinometer, said plate secured to said base in an adjustable inclined position, whereby said inclinometer may be inclined with respect to said base at any angle within a predetermined range;

adjusting means secured to said plate for adjusting said angle of inclination; and a cover for covering said inclinometer and adjusting means.

16. An inclinometer assembly for monitoring the taper of one of the faces of a continuous casting mold, said assembly comprising:

a base;

a plate for supporting an inclinometer, said plate secured to said base in an adjustable inclined position, whereby said inclinometer may be inclined with respect to said base at any angle within a predetermined range, said plate having a first end and a second end, said first end of said plate rigidly secured to said base;

adjusting means secured to said plate for adjusting said angle of inclination, said second end of said plate adjusted by said adjusting means which comprises a raising means for moving said second end of said plate away from said base and a lowering means for moving said second end of said plate toward said plate; and a cover for covering said inclinometer and adjusting means.

17. The apparatus according to claim 16, wherein said raising means comprises a threaded nut secured to said plate and a threaded stud threadedly received in said nut.

18. The apparatus according to claim 17, wherein said lowering means comprises a threaded fastener threadedly received in said base.

* * * * *